US012203341B2

(12) United States Patent
Xiao et al.

(10) Patent No.: US 12,203,341 B2
(45) Date of Patent: Jan. 21, 2025

(54) WIRELINE RETRIEVABLE AUTO Y-TOOL

(71) Applicant: SAUDI ARABIAN OIL COMPANY, Dhahran (SA)

(72) Inventors: Jinjiang Xiao, Dhahran (SA); Jamie Cochran, Aberdeenshire (GB); Rae Younger, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 116 days.

(21) Appl. No.: 18/153,238

(22) Filed: Jan. 11, 2023

(65) Prior Publication Data

US 2024/0229602 A1 Jul. 11, 2024

(51) Int. Cl.

| | |
|---|---|
| ***E21B 34/08*** | (2006.01) |
| ***E21B 23/02*** | (2006.01) |
| ***E21B 23/12*** | (2006.01) |
| ***E21B 43/12*** | (2006.01) |
| *E21B 31/00* | (2006.01) |

(52) U.S. Cl.
CPC ..... *E21B 34/08* (2013.01); *E21B 23/02* (2013.01); *E21B 23/12* (2020.05); *E21B 43/128* (2013.01); *E21B 31/00* (2013.01); *E21B 2200/05* (2020.05)

(58) Field of Classification Search
CPC ..... E21B 23/12; E21B 43/128
See application file for complete search history.

(56) References Cited

U.S. PATENT DOCUMENTS

| | | | | |
|---|---|---|---|---|
| 5,213,159 A * | 5/1993 | Schneider | ..... | E21B 43/121 175/48 |
| 5,975,209 A | 11/1999 | McCorry | | |
| 6,170,578 B1 * | 1/2001 | Edwards | ..... | E21B 33/035 166/359 |
| 7,736,133 B2 | 6/2010 | Martinez | | |

(Continued)

FOREIGN PATENT DOCUMENTS

| | | | | |
|---|---|---|---|---|
| GB | 2288197 A * | 10/1995 | ..... | E21B 23/00 |
| GB | 2505065 A | 2/2014 | | |

(Continued)

OTHER PUBLICATIONS

International Search Report and Written Opinion issued in Application No. PCT/US2024/010834, mailed on Mar. 25, 2024 (14 pages).

*Primary Examiner* — David Carroll
(74) *Attorney, Agent, or Firm* — Osha Bergman Watanabe & Burton LLP

(57) ABSTRACT

A system includes production tubing, a Y-tool, and a downhole tool. The Y-tool is installed within the production tubing and splits the production tubing into a first section, a second section, and a third section. The downhole tool is configured to be run through a conduit of the first section of the production tubing and configured to be installed within the production tubing. The downhole tool includes a valve assembly, a seal stack, and a locking mechanism. The valve assembly is configured to hydraulically connect either the second section of the production tubing or the third section of production tubing to the first section of production tubing. The seal stack is configured to mate with a seal bore of the second section of the production tubing. The locking mechanism is configured to mate with a lock profile of the second section of the production tubing.

18 Claims, 5 Drawing Sheets

(56) References Cited

U.S. PATENT DOCUMENTS

| | | | | |
|---|---|---|---|---|
| 8,863,849 | B2 | 10/2014 | Patel | |
| 9,303,496 | B2 | 4/2016 | Xiao et al. | |
| 9,470,072 | B2 | 10/2016 | Fielder et al. | |
| 10,167,708 | B2 | 1/2019 | Beveridge | |
| 10,975,659 | B2 | 4/2021 | Jordan | |
| 11,346,194 | B2 | 5/2022 | Al-Somali et al. | |
| 2003/0015323 | A1* | 1/2003 | Norris | E21B 34/08 166/313 |
| 2004/0060707 | A1* | 4/2004 | Bearden | E21B 41/02 166/380 |
| 2006/0231256 | A1* | 10/2006 | Rivas | E21B 43/128 166/387 |
| 2009/0200034 | A1 | 8/2009 | Leitch | |
| 2014/0360734 | A1* | 12/2014 | Doane | E21B 23/06 166/101 |
| 2015/0041126 | A1* | 2/2015 | Boyle | E21B 43/2406 166/57 |
| 2019/0368291 | A1 | 12/2019 | Xiao et al. | |
| 2020/0355047 | A1* | 11/2020 | Abdellatief | E21B 37/06 |
| 2022/0074290 | A1* | 3/2022 | Al-Somali | F16K 1/18 |
| 2022/0243558 | A1 | 8/2022 | Al Khalifah et al. | |
| 2023/0056868 | A1* | 2/2023 | Herndon | E21B 33/1285 |

FOREIGN PATENT DOCUMENTS

| | | | |
|---|---|---|---|
| GB | 2583005 | A | 10/2020 |
| RU | 2731447 | C1 | 9/2020 |
| WO | 2007026141 | A1 | 3/2007 |
| WO | 2017184793 | A1 | 10/2017 |

* cited by examiner

WIRELINE RETRIEVABLE AUTO Y-TOOL

BACKGROUND

Hydrocarbon fluids are often found in hydrocarbon reservoirs located in porous rock formations far below the Earth's surface. Wells may be drilled to extract the hydrocarbon fluids from the hydrocarbon reservoirs. Most wells have a variation of downhole equipment, such as Electrical Submersible Pump (ESP) systems, installed to help with the production of hydrocarbons. Once the ESP system is installed in the well, there is no way to access the main bore and any lateral bores downhole from the ESP system without completely removing the ESP as through-tubing tools are unable to pass through the inside of the ESP.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for a Y-tool installed in production tubing. The system includes, in accordance with one or more embodiments, production tubing, a Y-tool, and a downhole tool. The production tubing has a conduit extending therein. The Y-tool is installed within the production tubing and splits the production tubing into a first section, a second section, and a third section. The downhole tool is configured to be run through the conduit of the first section of the production tubing and configured to be installed within the production tubing. The downhole tool includes a valve assembly, a seal stack, and a locking mechanism. The valve assembly is configured to hydraulically connect either the second section of the production tubing or the third section of production tubing to the first section of production tubing. The seal stack is configured to mate with a seal bore of the second section of the production tubing. The locking mechanism is configured to mate with a lock profile of the second section of the production tubing.

The method, in accordance with one or more embodiments, includes installing a Y-tool into production tubing to split the production tubing into a first section, a second section, and a third section, running a downhole tool through the conduit of the first section of the production tubing, and installing the downhole tool in the production tubing. The method further includes sealing the downhole tool in the second section of the production tubing by mating a seal stack of the downhole tool with a seal bore of the second section of the production tubing, locking the downhole tool in the second section of the production tubing by operating a locking mechanism of the downhole tool to mate with a locking profile of the second section of the production tubing, and hydraulically connecting either the second section or the third section of the production tubing to the first section of the production tubing using a valve assembly located within the downhole tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
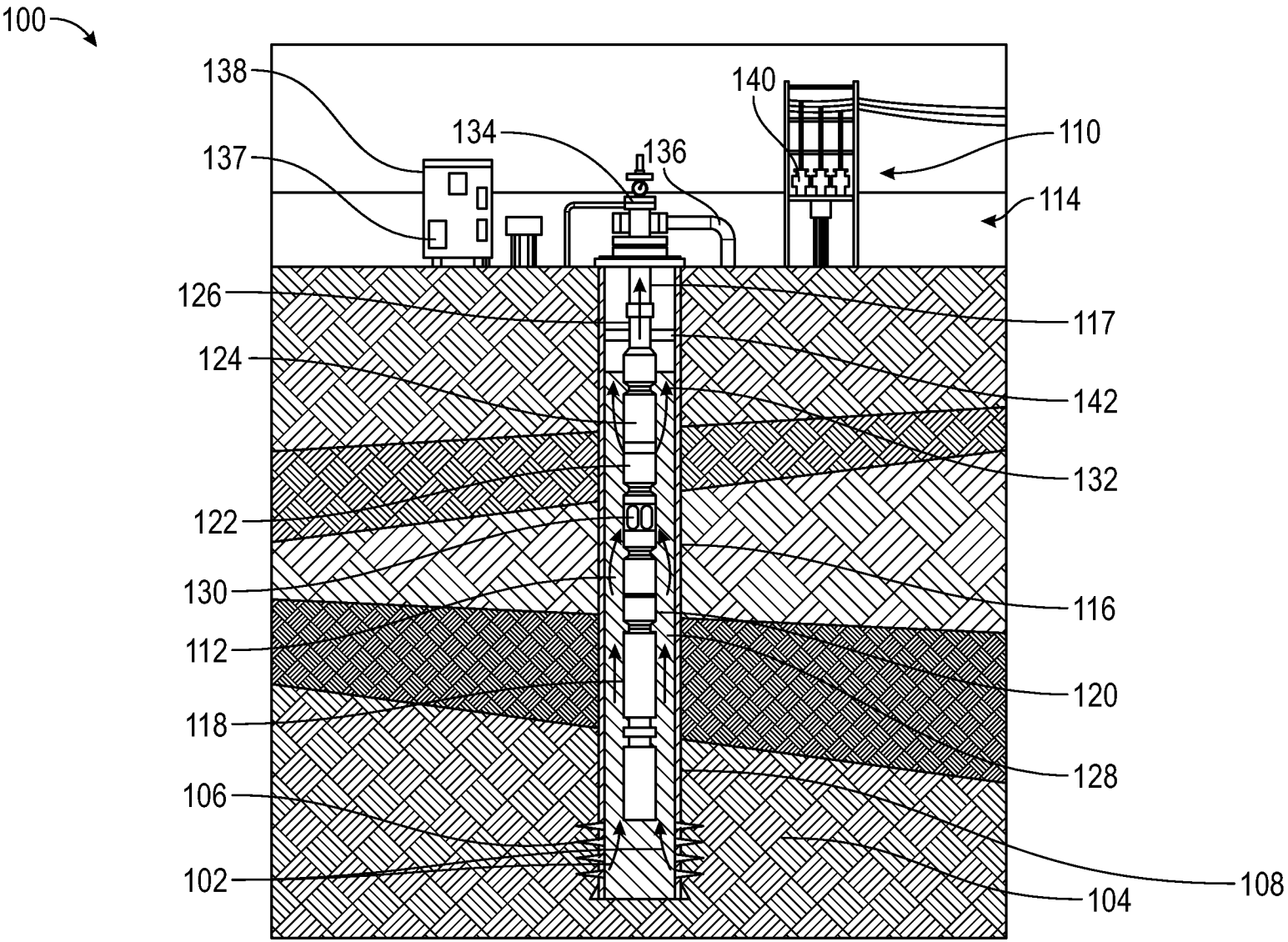
FIG. 1 shows an exemplary ESP system in accordance with one or more embodiments.

FIG. 1 shows an exemplary ESP system (100) in accordance with one or more embodiments. The ESP system (100) is used to help produce produced fluids (102) from a formation (104). Perforations (106) in the well's (116) casing (108) provide a conduit for the produced fluids (102) to enter the well (116) from the formation (104). The ESP system (100) includes a surface portion having surface equipment (110) and a downhole portion having an ESP string (112). The ESP string (112) is deployed in a well (116) on production tubing (117) and the surface equipment (110) is located on a surface location (114). The surface location (114) is any location outside of the well (116), such as the Earth's surface. The production tubing (117) extends to the surface location (114) and is made of a plurality of tubulars connected together to provide a conduit for produced fluids (102) to migrate to the surface location (114).

The ESP string (112) may include a motor (118), motor protectors (120), a gas separator (122), a multi-stage centrifugal pump (124) (herein called a "pump" (124)), and a power cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (116) to the surface location (114). The motor (118) is cooled by the produced fluids (102) passing over the motor (118) housing. The motor (118) is powered by the power cable (126). The power cable (126) is an electrically conductive cable that is capable of transferring information. The power cable (126) transfers energy from the surface equipment (110) to the motor (118). The power cable (126) may be a three-phase electric cable that is specially designed for downhole environments. The power cable (126) may be clamped to the ESP string (112) in order to limit power cable (126) movement in the well (116).

Motor protectors (120) are located above (i.e., closer to the surface location (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (116) between the casing (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface location (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity. The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface location (114).

A packer (142) is disposed around the ESP string (112). Specifically, the packer (142) is located above (i.e., closer to the surface location (114)) the multi-stage centrifugal pump (124). The packer (142) may be any packer (142) known in the art such as a mechanical packer (142). The packer (142) seals the annulus (128) space located between the ESP string (112) and the casing (108). This prevents the produced fluids (102) from migrating past the packer (142) in the annulus (128).

In other embodiments, sensors may be installed in various locations along the ESP string (112) to gather downhole data such as pump intake volumes, discharge pressures, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface location (114), the produced fluids (102) flow through the wellhead (134) into production equipment (136). The production equipment (136) may be any equipment that can gather or transport the produced fluids (102) such as a pipeline or a tank.

The remainder of the ESP system (100) includes various surface equipment (110) such as electric drives (137) and pump control equipment (138) as well as an electric power supply (140). The electric power supply (140) provides energy to the motor (118) through the power cable (126). The electric power supply (140) may be a commercial power distribution system or a portable power source such as a generator.

The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

For many ESP completion systems, such as the ESP system (100) depicted in FIG. 1, there is no way to access the portion of the well (116) located beneath (i.e., further away from the surface location (114)) the ESP string (112) without completely removing the ESP string (112). A Y-tool may be used to employ a bypass tubing that provides a conduit for a through-tubing tool to by-pass the ESP string (112) and access deeper portions of the well (116).

The ESP string (112) may be by-passed for the purposes of intervention operations or production logging on an active well (116). Flow between the two legs of the Y-tool may be controlled via an auto valve or by installation of a blanking plug in the by-pass leg. However, when using an auto valve and when produced fluids (102) are being pumped to the surface location (114) by the pump (124) through the Y-tool, the produced fluids (102) may back flow into the bypass leg of the Y-tool. When using a blanking plug, multiple trips into the production tubing (117) may be required to install and remove the blanking plug.

Further, when a through tubing tool is being run into the production tubing (117), fluid used to pump the through tubing tool into the production tubing (117) may enter the ESP string (112). Thus, systems and methods that can prevent back flow of fluid into the by-pass tubing and flow of fluid from the surface location (114) into the ESP string (112) is beneficial. As such, embodiments disclosed herein disclose a downhole tool that may be run into and installed within a Y-tool. The downhole tool enables selective hydraulic connection between the various downhole tubulars using a valve assembly. The valve assembly is retrievable separately from the ESP string (112) such that the valve assembly may be retrieved upon failure without having to disassemble the ESP string (112).

Figure 2A:
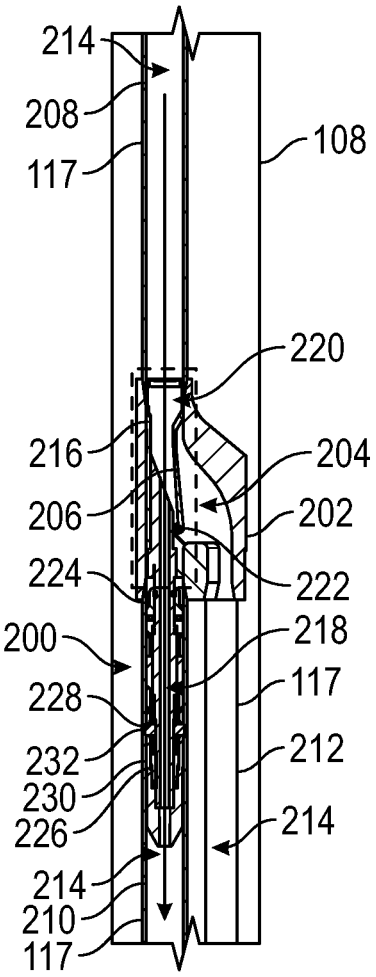
FIGS. 2*a* and 2*b* show a downhole tool deployed in production tubing having a Y-tool (202) in accordance with one or more embodiments.
Figure 2B:
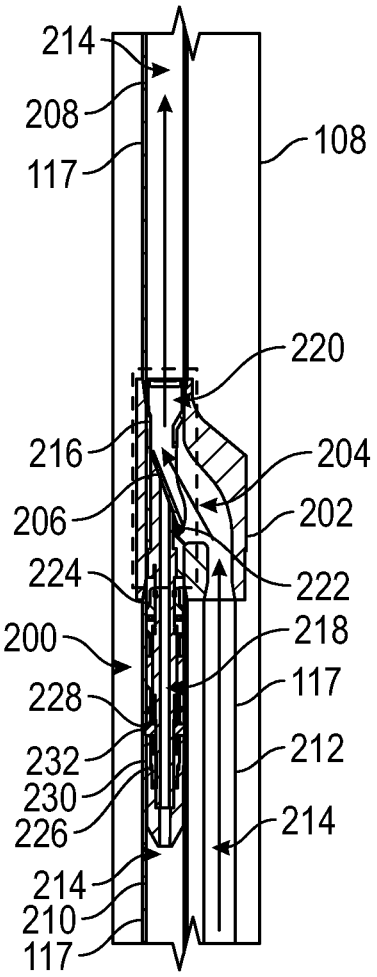

FIGS. 2*a* and 2*b* show a downhole tool (200) deployed in production tubing (117) having a Y-tool (202) in accordance with one or more embodiments. Specifically, FIG. 2*a* shows a valve assembly (204) of the downhole tool (200) having an oval flapper (206) in a first position, and FIG. 2 shows the oval flapper (206) of the downhole tool (200) in a second position. Components shown in FIGS. 2*a* and 2*b* that are the same as or similar to components shown in FIG. 1 have not been redescribed for purposes of readability and have the same description and function as outlined above.

The production tubing (117) is shown deployed and installed within casing (108). The Y-tool (202) is installed in the production tubing (117) and splits the production tubing (117) into three sections: a first section (208), a second section (210), and a third section (212). In accordance with one or more embodiments, the first section (208) is the section of production tubing (117) that extends from the Y-tool (202) to the surface location (114).

The second section (210) is the section of the production tubing (117) that extends from the Y-tool (202) to the lower completions. The lower completions is the portion of the well (116) that is located downhole from the ESP string (112). This may include an open hole section, one or more lateral sections, completed casing (108), etc. The second section (210) may also be considered "by-pass tubing".

The third section (212) is the section of the production tubing (117) that extends from the Y-tool (202) to be connected to the ESP string (112). When the downhole tool (200) is not installed in the Y-tool (202)/production tubing (117), a hydraulic connection exists between all three sections (208, 210, 212) via a conduit (214). The conduit (214) extends through the production tubing (117). The conduit (214) branches from a single conduit (214) in the first section (208) to two conduits (214): one conduit (214) in the second section (210) and one conduit (214) in the third section (212).

The branching of the conduit (214) occurs in the Y-tool (202) as does the branching of the production tubing (117). The three sections (208, 210, 212) of the production tubing (117) may each comprise of one or more individual stands of production tubing (117) threaded together. Further, each section (208, 210, 212) of the production tubing (117) may have other components installed thereon without departing from the scope of the disclosure herein.

In accordance with one or more embodiments, the downhole tool (200) includes a fishing profile (216), a valve assembly (204), and a blanking plug (218). The fishing profile (216), the valve assembly (204), and the blanking plug (218) may be three separate components installed together or they may be machined together as one or more tubular bodies without departing from the scope of the disclosure herein. The downhole tool (200) has a through bore (220) that extends through the entirety of the downhole tool (200). The bore (220) allows for hydraulic connection between the conduits (214) of the three sections (208, 210, 212) of production tubing (117) depending on the placement of the oval flapper (206) of the valve assembly (204).

In accordance with one or more embodiments, the fishing profile (216) is machined into the inner surface of the downhole tool (200). The inner surface of the downhole tool (200) defines the bore (220) of the downhole tool (200). The design of the fishing profile (216) machined into the downhole tool (200) allows the fishing profile (216) to interact or mate with a fishing tool or a running tool (not pictured). This interaction allows the fishing or running tool to engage with and connect to the downhole tool (200). The fishing or running tool may be any fishing or running tool known in the art, such as a fishing bottom hole assembly or a Camco JD running tool. The fishing or running tool may be deployed in the production tubing (117) via any deployment device (not pictured) known in the art, such as wireline, coiled tubing, or slickline.

The valve assembly (204) includes the oval flapper (206) disposed in a bore (220) of the downhole tool (200). The bore (220) in the valve assembly (204) is off center as shown in FIGS. 2*a* and 2*b* to minimize flow restriction regardless of orientation of the downhole tool (200) in the Y-tool (202). The oval flapper (206) is angled to axial direction in the valve assembly (204) (i.e., the oval flapper (206) is not perpendicular to the flow path in the valve assembly (204)). For example, the oval flapper (206) is angled at 30 degrees from perpendicular to the bore (220) of the valve assembly (204). The valve assembly (204) is sized such that it does not protrude outside the running outer diameter of the downhole tool (200).

When the downhole tool (200) is installed within the production tubing (117), the valve assembly (204) of the downhole tool (200) enables selective hydraulic access between the conduits (214) of the three sections (208, 210, 212). In accordance with one or more embodiments, the valve assembly (204) is configured to hydraulically connect either the second section (210) of the production tubing (117) or the third section (212) of the production tubing (117) to the first section (208) of the production tubing (117) using the oval flapper (206). The oval flapper (206) is connected to the downhole tool (200) via a spring (222). The spring (222) may be any spring known in the art, such as a leaf spring.

The oval flapper (206) is formed in an oval-shape due to the angle at which the oval flapper (206) resides at in the bore (220) to block flow. This shape allows the oval flapper (206) to block a flow of fluid through the conduit (214) of the production tubing (117). The oval flapper (206) is movable between a first position and a second position. As stated above, FIG. 2*a* shows the oval flapper (206) of the valve assembly (204) in the first position, and FIG. 2*b* shows the oval flapper (206) of the valve assembly (204) in the second position.

The first position of the oval flapper (206) is the natural position of the valve assembly (204). That is, the spring (222) keeps the oval flapper (206) in the first position when there are no external forces working on the system. The first position comprises the oval flapper (206) blocking the conduit (214) between the first section (208) and the third section (212) of the production tubing (117). The first position enables hydraulic communication between the first section (208) of the production tubing (117) and the second section (210) of the production.

With the oval flapper (206) in the first position, a fluid may be pumped from the surface location (114) to the lower completions of the well (116). Further, a through tubing tool, such as a workover tool, may be run from the first section (208) of the production tubing (117), through the bore (220) of the downhole tool (200), and into the second section (210) of the production tubing (117). This allows for workover operations or secondary completions operations to occur downhole from the ESP string (112) without having to de-complete the ESP string (112). Further, the first position allows for the hydraulic communication to be severed between the first section (208) and the third section (212).

The second position comprises the oval flapper (206) blocking the conduit (214) between the first section (208) and the second section (210) of the production tubing (117), as shown in FIG. 2*a*. That is, the second position enables hydraulic communication between the first section (208) and the third section (212) of the production tubing (117) and severs hydraulic communication between the first section (208) and the second section (210) of the production tubing (117).

The second position occurs when the spring (222) is compressed. In accordance with one or more embodiments, the oval flapper (206) is movable between the first position and the second position based on a flow of fluid coming from the conduit (214) of the third section (212) of the production tubing (117). That is, the flow of fluid exerts a force on the oval flapper (206) to compress the spring (222) and move the oval flapper (206) from the first position to the second position.

In accordance with one or more embodiments, the produced fluids (102) may exert enough pressure on the oval flapper (206) to compress the spring (222) and place the oval flapper (206) in the second position. Thus, when the ESP string (112) is undergoing normal operations and produced fluids (102) are being pumped to the surface location (114) using the electric submersible pump (124), the oval flapper (206) is placed in the second position due to the force exerted by the produced fluids (102). Further, when the flow of production fluids (102) stops, the oval flapper (206) reverts to its natural state in the first position due to the spring (222) decompressing.

The blanking plug (218) portion of the downhole tool (200) is the portion of the downhole tool (200) that enables the downhole tool (200) to be installed in the production tubing (117). Specifically, the blanking plug (218) may be comprised of a plug mandrel (224) having a seal stack (226) and a locking mechanism (228). In accordance with one or more embodiments, the plug mandrel (224) is a tubular body having an inner surface defining at least a portion of the bore (220) extending through the downhole tool (200). The seal stack (226) and the locking mechanism (228) are disposed on the outer surface of the plug mandrel (224) such that the seal stack (226) and the locking mechanism (228) are located between the blanking plug (218) and the production tubing (117).

The seal stack (226) is configured to sealingly engage with a seal bore (230) of a tubular body. The seal stack (226) may include one or more sealing mechanisms such as O-rings or any other seals known in the art. The sealing mechanism in the seal stack (226) may be made of any material known in the art, such as rubber, plastic, metal, etc. Further, each sealing mechanism may be made of a different material from one another without departing from the scope of the disclosure herein. The locking mechanism (228) is configured to mate with a lock profile (232) of a tubular body in order to lock the downhole tool (200) in place within the tubular body.

The seal bore (230) and the lock profile (232) may be located on the production tubing (117), or the seal bore (230) and the lock profile (232) may be located within the Y-tool (202). In accordance with one or more embodiments, and as shown in FIGS. 2*a* and 2*b*, the second section (210) of the production tubing (117) includes the seal bore (230) and the lock profile (232). The seal bore (230) and the lock profile (232) may be machined into the inner surface of the second section (210) of the production tubing (117).

When the seal stack (226) engages with the seal bore (230) of the second section (210) of the production tubing (117), a seal is formed between the downhole tool (200) and the production tubing (117) via the seal stack (226) mating with the seal bore (230). In accordance with one or more embodiments, the seal is fluid-tight for fluids moving between the second section (210) and the first section (208) of the production tubing (117). The locking mechanism (228) may be any locking mechanism known in the art. For example, the locking mechanism (228) may be a set of locking dogs. Specifically, the locking mechanism (228) may be type A or type D nipple locking dogs.

In accordance with one or more embodiments, the locking mechanism (228) may be compressed into the downhole tool (200) as the downhole tool (200) is being run in the production tubing (117). This compression into the downhole tool (200) may be pressure based due to the lack of clearance provided by the inner surface of the production tubing (117), or this compression may be electronically based. That is, the downhole tool (200) may have electrical components that instruct the locking mechanism (228) to stay within the downhole tool (200) until a signal tells the electrical components to jut out the locking mechanism (228) out from the downhole tool (200).

Once the locking mechanism (228) is located within the locking profile (216), the locking mechanism (228) may jut out. The jutting of the locking mechanism (228) may be due to any means known in the art. For example, springs may push the locking mechanism (228) away from the downhole tool (200) and into the locking profile (216) when the obstruction, caused by the inner surface of the production tubing (117), is removed.

In other embodiments, the jutting of the locking mechanism (228) may be due to a signal being sent to the downhole tool (200), via wireline, to move the locking mechanism (228) away from the body of the downhole tool (200) and into the locking profile (216). In further embodiments, the locking mechanism (228) may be retracted into the downhole tool (200) via a second signal, or via a mechanical maneuvering of the downhole tool (200) within the production tubing (117).

As stated above, the fishing profile (216), the valve assembly (204), and the blanking plug (218) may be configured in a myriad of ways. For purposes of example only and in accordance with one or more embodiments, the plug mandrel (224) of the blanking plug (218) is connected to the valve assembly (204) through any means known in the art, such as a welded or threaded connection. The through bore (220) of the downhole tool (200) extends from the blanking plug (218) through the valve assembly (204) to the fishing profile (216). The fishing profile (216) may be machined into the inner surface of the valve assembly (204) at an end of the valve assembly (204) opposite the end of the valve assembly (204) that is connected to the blanking plug (218).

In accordance with one or more embodiments, the fishing or running tool may be a fishing bottom hole assembly connected to the deployment device, and the fishing bottom hole assembly may be connected to the downhole tool (200) through interaction between the fishing profile (216) and the fishing bottom hole assembly. In accordance with one or more embodiments, the downhole tool (200) is run into the conduit (214) of the first section (208) of the production tubing (117) using wireline.

When the downhole tool (200) is located at a set depth (i.e., within the Y-tool (202)), a signal to release the downhole tool (200) may be sent to the fishing or running tool via the wireline. In further embodiments, when the locking mechanism (228) engages with the lock profile (232) of the second section (210) of production tubing (117), a tensile force may be seen across the fishing or running tool by pulling up on the downhole tool (200) via the deployment device. Once the tensile force reaches a pre-determined valve, the fishing or running tool may release the downhole tool (200).

In further embodiments, the downhole tool (200) may be removed from the Y-tool (202) and production tubing (117) using the fishing or running tool and the deployment mechanism. Specifically, the fishing or running tool may be lowered into the production tubing (117) to engage with the fishing profile (216) of the downhole tool (200). As explained above, the locking mechanism (228) may retract back into the downhole tool (200) via mechanical maneuvers of the downhole tool (200) or via electrical signals sent through the deployment device. Once the locking mechanism (228) is retracted into the downhole tool (200), the deployment device may remove the downhole tool (200) from the production tubing (117) though the connection between the fishing profile (216) and the fishing or running tool.

In accordance with one or more embodiments, the valve assembly (204) is rated at 5000 psi maximum working pressure (MWP) from above or below. The downhole tool (200) can withstand temperatures of up to 350 degrees Fahrenheit when elastomers are used in the seal stack (226). The major components of the downhole tool (200) may be made with any durable material known in the art such as low alloy steel or 17/4 ST.ST. The seals in the seal bore (230) may be Viton or Aflas seals, or the seals may be non-elastomeric.

The installation of the downhole tool (200) in the production tubing (117) as shown in FIGS. 2*a* and 2*b* is an exemplary installation. However, the downhole tool (200) is designed such that the downhole tool (200) will operate as designed no matter the orientation of the downhole tool (200) within the Y-tool (202). FIGS. 3*a*-4*c* show various orientations of the downhole tool (200) within the Y-tool (202).

Figure 3A:
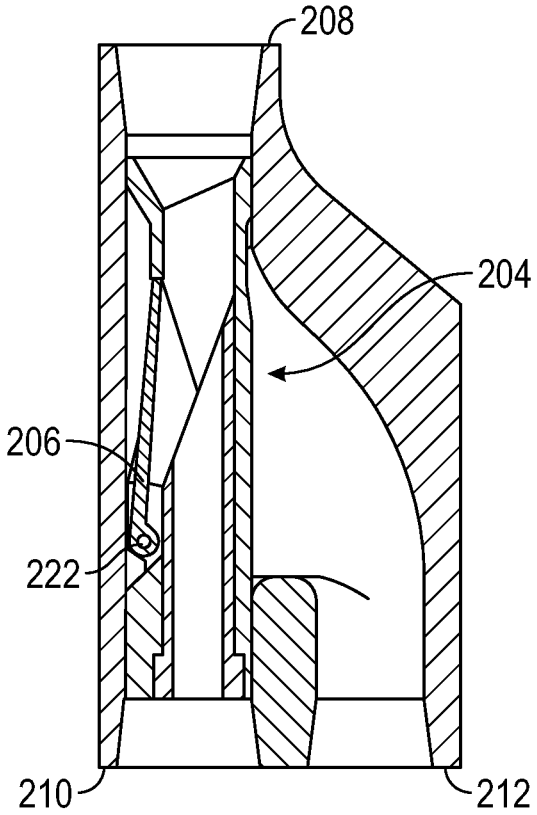
FIGS. 3*a* and 3*b* show a side view of the orientations of the downhole tool within the production tubing in accordance with one or more embodiments.
Figure 3B:
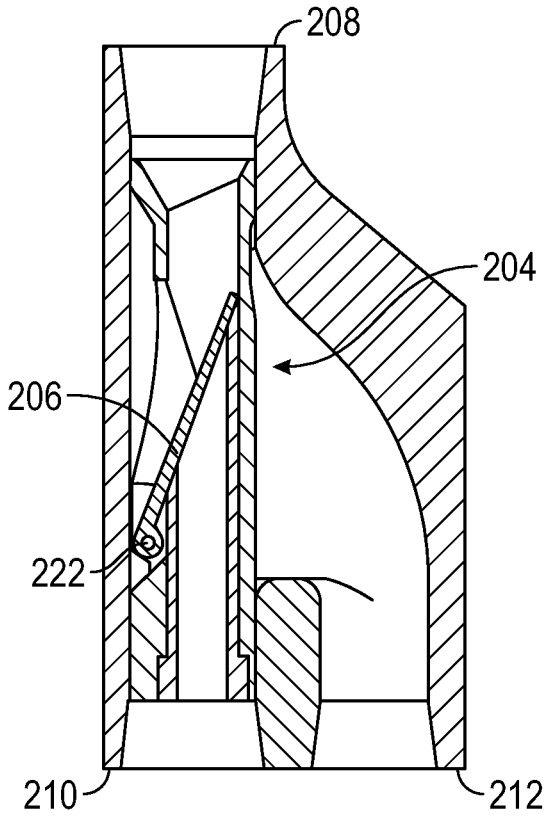
Figure 4B:
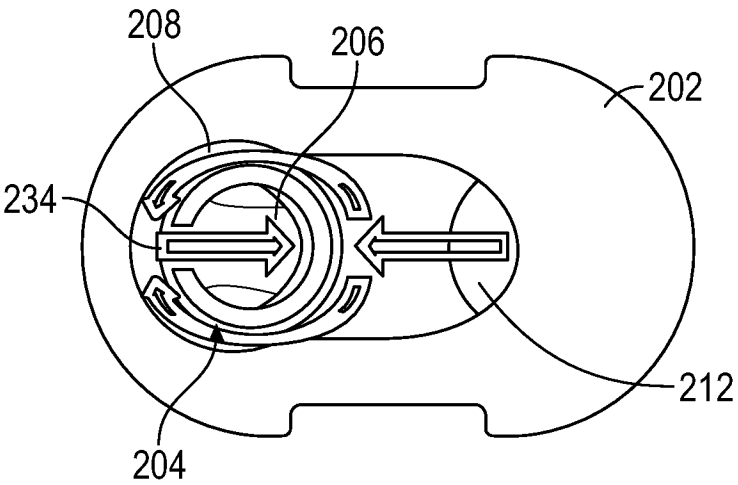
FIGS. 4*a*-4*c* show a top view of the various orientations of the downhole tool within the production tubing in accordance with one or more embodiments.
Figure 4A:
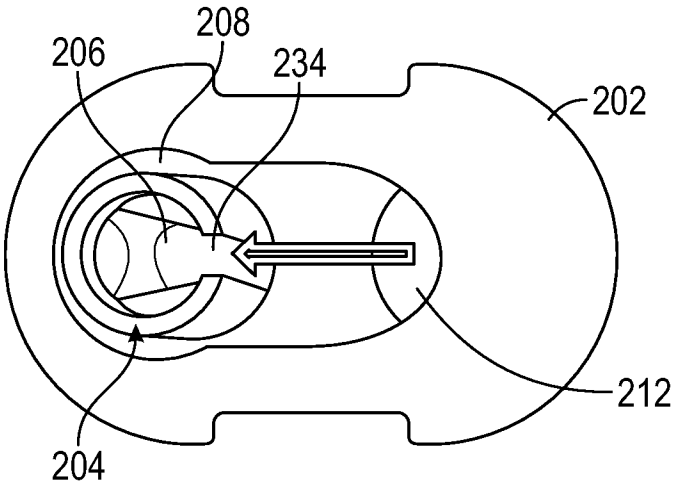
Figure 4C:
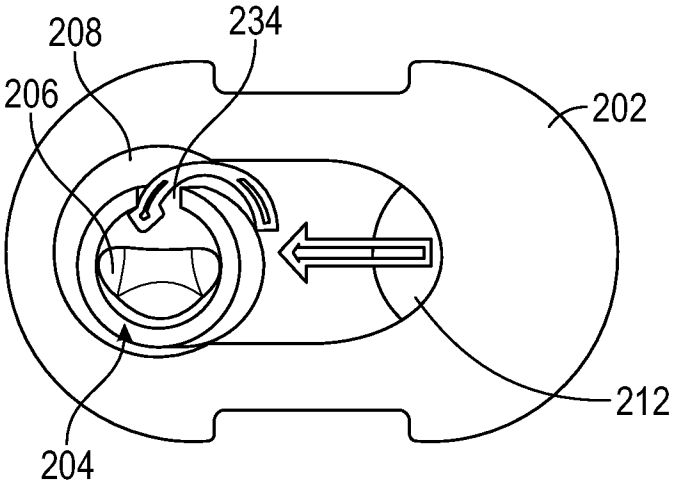

FIGS. 3*a* and 3*b* show a side view of the orientations of the downhole tool (200) within the production tubing (117). FIGS. 4*a*-4*c* show a top view of the various orientations of the downhole tool (200) within the production tubing (117). FIGS. 4*a*-4*c* also show, via arrows, how fluid flows within the valve assembly (204) at the various orientations. Components shown in FIGS. 3*a*-4*c* that are the same as or similar to components shown in FIGS. 1-2*b* have not been redescribed for purposes of readability and have the same description and function as outlined above.

FIG. 4*a* shows the valve assembly (204) installed within the Y-tool (202) at the exemplary orientation outlined in FIGS. 2*a* and 2*b*. FIG. 4*a* further shows, via arrows, how the fluid flows directly from the third section (212) of the production tubing (117) into the first section (208) of the production tubing. FIG. 4*a* further shows an opening (234) created by movement of the oval flapper (206) from the first position to the second position. The opening (234) represents the hydraulic connectivity between the third section (212) and the first section (208) of the production tubing (117)

FIGS. 3*a*, 3*b*, and 4*b* show the valve assembly (204) installed within the Y-tool (202) at an orientation 180 degrees away from the exemplary installation shown in FIGS. 2*a* and 2*b*. As can be seen in FIG. 4*b*, via the arrows, the fluid is able to maneuver around the outside of the valve assembly (204) within the Y-tool (202). This is due to the valve assembly (204) having an outer diameter that is small enough that a space is created between the outside of the valve assembly (204) and the inside of the Y-tool (202).

With the fluid able to maneuver around the valve assembly (204), as shown in FIG. 4*b*, the oval flapper (206) is able to be moved from the first position to the second position due to the pressure exerted by the fluid. Once again, movement of the oval flapper (206) between the first position and the second position creates the opening (234) and allows the fluid to flow from the third section (212) to the first section (208) of the production tubing (117).

FIG. 4*c* shows the valve assembly (204) installed within the Y-tool (202) at an orientation 90 degrees away from the exemplary installation shown in FIGS. 2*a* and 2*b*. As can be seen in FIG. 4*c*, via the arrows, the fluid is able to maneuver around the outside of the valve assembly (204) within the Y-tool (202). Thus, the fluid is able to open the oval flapper (206) and enter the first section (208) of the production tubing (117) from the third section.

Figure 5:
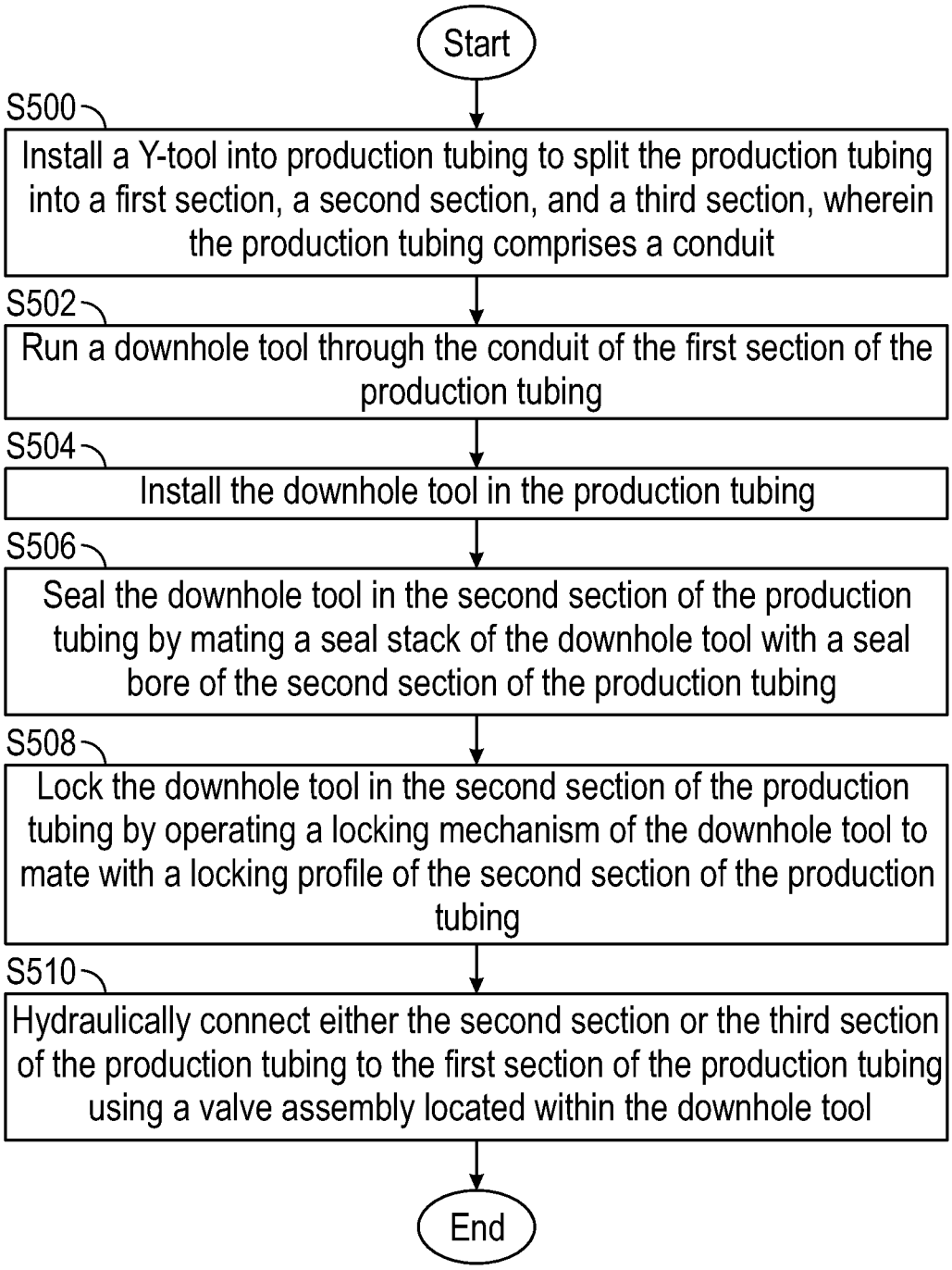
FIG. 5 shows a flowchart in accordance with one or more embodiments.

FIG. 5 shows a flowchart in accordance with one or more embodiments. The flowchart outlines a method for using a downhole tool (200) in production tubing (117). While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In step 500, a Y-tool (202) is installed into production tubing (117) to split the production tubing (117) into a first section (208), a second section (210), and a third section (212), wherein the production tubing (117) comprises a conduit (214). In accordance with one or more embodiments, the production tubing (117) may be disposed in a well (116). The well (116) may be completed using an ESP string (112).

The third section (212) may be connected to the ESP string (112). The second section (210) may be used as by-pass tubing to access the portion of the well (116) downhole from the ESP string (112). The first section (208) may be production tubing (117) that extends to the surface location (114) and may be used to channel the produced fluids (102), pumped from the ESP string (112), to the surface location (114).

The first section (208) may also be used as a conduit for running through tubing tools from the surface location (114) into the second section (210) of the production tubing (117). The Y-tool (202) may be an existing Y-tool (202) installed in the well (116), or the Y-tool (202) may be a specific Y-tool (202) designed to be used with the downhole tool (200) without departing from the scope of the disclosure herein.

In step 502, a downhole tool (200) is run into the conduit (214) of the first section (208) of the production tubing (117). In accordance with one or more embodiments, the downhole tool (200) comprises a fishing profile (216), a valve assembly (204), and a blanking plug (218). The downhole tool (200) may be run into the production tubing (117) using any deployment mechanism known in the art, such as wireline, slickline, or coiled tubing.

The deployment mechanism may connect to the downhole tool (200) using a running or fishing tool that is configured to engage with the fishing profile (216) of the downhole tool (200). Engagement of the running or fishing tool with the fishing profile (216) may occur by simply lowering the running or fishing tool into the fishing profile (216) of the downhole tool (200). The mechanical design of the fishing profile (216) and the running or fishing tool may be such that a connection is created when the two interact with one another.

In accordance with one or more embodiments, the downhole tool (200) is deployed in the production tubing (117) using a wireline-deployable running tool. The wireline-deployable running tool is connected to the fishing profile (216) of the downhole tool (200). The wireline, connected to the wireline-deployable running tool, lowers the downhole tool (200) to a depth in the production tubing (117) that coincides with the Y-tool (202).

In step 504, the downhole tool (200) is installed in the production tubing (117). In step 506, the downhole tool (200) is sealed in the second section (210) of the production tubing (117) by mating a seal stack (226) of the downhole tool (200) with a seal bore (230) of the second section (210) of the production tubing (117). The seal stack (226) may mate with the seal bore (230) by simply entering the seal bore (230). In step 508, the downhole tool (200) is locked in the second section (210) of the production tubing (117) by operating a locking mechanism (228) of the downhole tool (200) to mate with a locking profile (216) of the second section (210) of the production tubing (117).

In accordance with one or more embodiments, installation of the downhole tool (200) in the production tubing (117) includes lowering the blanking plug (218) of the downhole tool (200) into the second section (210) of the production tubing (117). As the locking mechanism (228) enters the lock profile (232), the locking mechanism (228) juts out into the lock profile (232). The jutting of the locking mechanism (228) may be caused by an electronic signal or mechanical methods.

In step 510, the second section (210) or the third section (212) of the production tubing (117) is hydraulically connected to the first section (208) of the production tubing (117) using a valve assembly (204) located within the downhole tool (200). In accordance with one or more embodiments, hydraulically connecting either the second section (210) or the third section (212) with the first section (208) includes moving an oval flapper (206) of the valve assembly (204) between a first position and a second position.

When the oval flapper (206) is in the first position, the conduit (214) between the first section (208) and the third section (212) of the production tubing (117) is blocked, and the conduit (214) between the first section (208) and the second section (210) of the production tubing (117) is open. The oval flapper (206) may naturally reside in the first position due to pressure applied on the oval flapper (206) by a spring (222).

When the oval flapper (206) is in the second position, the conduit (214) between the first section (208) and the second section (210) of the production tubing (117) is blocked, and the conduit (214) between the first section (208) and the third section (212) of the production tubing (117) is open. The oval flapper (206) may be moved from the first position to the second position by a force (a force large enough to overcome the force exerted by the spring (222)) being exerted on the oval flapper (206).

In accordance with one or more embodiments, produced fluids (102) may be pumped from the third section (212) via the pump (124) in the ESP string (112). The pressure exerted by the produced fluids (102) moves the oval flapper (206) from the first position to the second position. The oval flapper (206) may be moved from the second position to the first position when the pump (124) stops pumping the produced fluids (102).

In further embodiments, the downhole tool (200) may be removed from the production tubing (117) in a similar manner to its installation. Specifically, a deployment device having a running or fishing tool may be lowered into the conduit (214) of the first section (208) of production tubing (117). When the running or fishing tool reaches the depth of the downhole tool (200), the running or fishing tool may enter the bore (220) of the downhole tool (200) to mate with the internal fishing profile (216) of the downhole tool (200).

Through mechanical movement (such as jarring) or electronic signals, the locking mechanism (228) may be retracted into the downhole tool (200), and the downhole tool (200) may be pulled to the surface location (114) via the deployment mechanism. In further embodiments, the locking mechanism (228) may be a set of locking dogs and the locking dogs may be operated to jut in or out of the downhole tool (200) via mechanical movement of the downhole tool (200) or electronic signals sent from the surface via the deployment mechanism.

In other embodiments, and when an existing blanking plug is installed in the production tubing (117) having a conventional Y-tool (202), the existing blanking plug may be removed using the running or fishing tool. The downhole tool (200) may then be run into the Y-tool (202) to convert the conventional Y-tool (202) into an "auto" Y-tool (202). The ESP string (112) may be switched on from the surface location (114) and the flow of the produced fluids (102) cause the oval flapper (206) move to the second position and seal the bypass leg (i.e., the third section (212)). The ESP string (112) may be switched off at the surface location (114) causing the oval flapper (206) to move to the first position allowing backflow of fluid to be directed to the bypass leg around the ESP string (112).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system comprising:

production tubing having a conduit extending therein;

a Y-tool installed within the production tubing, wherein the Y-tool splits the production tubing into a first section, a second section, and a third section; and a downhole tool configured to be run through the conduit of the first section of the production tubing and configured to be installed within the production tubing, the downhole tool comprising:

a valve assembly comprising an oval flapper movable between a first position and a second position and configured to hydraulically connect either the second section of the production tubing or the third section of production tubing to the first section of production tubing using the oval flapper;

a seal stack configured to mate with a seal bore of the second section of the production tubing; and a locking mechanism configured to mate with a lock profile of the second section of the production tubing.

2. The system of claim 1, wherein the first position comprises the oval flapper blocking the conduit between the first section and the third section of the production tubing.

3. The system of claim 1, wherein the second position comprises the oval flapper blocking the conduit between the first section and the second section of the production tubing.

4. The system of claim 1, wherein the oval flapper is movable between the first position and the second position using a spring, and wherein a flow of fluid coming from the conduit of the third section of the production tubing is configured to move the oval flapper between the first position and the second position by compressing the spring.

5. The system of claim 4, wherein the third section of the production tubing is connected to an electric submersible pump string.

6. The system of claim 5, further comprising an electric submersible pump located in the electric submersible pump string, wherein the electric submersible pump is configured to pump the flow of fluid through the conduit of the third section of the production tubing.

7. The system of claim 1, wherein the valve assembly further comprises a fishing profile.

8. The system of claim 7, wherein the fishing profile is configured to mate with a wireline-deployable running tool.

9. The system of claim 1, wherein the locking mechanism further comprises locking dogs.

10. A method comprising:

installing a Y-tool into production tubing to split the production tubing into a first section, a second section, and a third section, wherein the production tubing comprises a conduit;

running a downhole tool through the conduit of the first section of the production tubing;

installing the downhole tool in the production tubing;

sealing the downhole tool in the second section of the production tubing by mating a seal stack of the downhole tool with a seal bore of the second section of the production tubing;

locking the downhole tool in the second section of the production tubing by operating a locking mechanism of the downhole tool to mate with a locking profile of the second section of the production tubing; and hydraulically connecting either the second section or the third section of the production tubing to the first section of the production tubing by moving an oval flapper valve of a valve assembly, located within the downhole tool, between a first position and a second position.

11. The method of claim 10, wherein moving the oval flapper valve to the first position further comprises blocking the conduit between the first section and the third section of the production tubing.

12. The method of claim 10, wherein moving the oval flapper valve to the second position further comprises blocking the conduit between the first section and the second section of the production tubing.

13. The method of claim 10, wherein moving the oval flapper valve of the valve assembly between the first position and the second position further comprises pumping a fluid from the conduit of the third section of the production tubing.

14. The method of claim 13, wherein the third section of the production tubing is connected to an electric submersible pump string.

15. The method of claim 14, wherein pumping the fluid from the conduit of the third section of the production tubing further comprises pumping the fluid using an electric submersible pump in the electric submersible pump string.

16. The method of claim 10, wherein running the downhole tool into the conduit of the first section of the production tubing further comprises connecting a fishing profile of the downhole tool to a running tool.

17. The method of claim 16, wherein running the downhole tool into the conduit of the first section of the production tubing further comprises running the downhole tool into the conduit of the first section of the production tubing using wireline connected to the running tool.

18. The method of claim 10, wherein locking the downhole tool in the second section of the production tubing further comprises operating locking dogs located on the downhole tool.

* * * * *